US005149373A

United States Patent [19]

Gondrand

[11] Patent Number: 5,149,373

[45] Date of Patent: Sep. 22, 1992

[54] INSTALLATION FOR APPLYING A COATING PRODUCT

[75] Inventor: Michel Gondrand, Vizille, France

[73] Assignee: Sames S.A., Meylan, France

[21] Appl. No.: 453,817

[22] Filed: Dec. 19, 1989

[30] Foreign Application Priority Data

Dec. 21, 1988 [FR] France ..... 88 16912

[51] Int. Cl.[5] ..... B05B 15/12

[52] U.S. Cl. ..... 118/634; 118/309; 118/326

[58] Field of Search ..... 118/312, 326, 634, 309; 55/DIG. 46; 52/79.5, 79.12, 127.6; 454/50, 51

[56] References Cited

U.S. PATENT DOCUMENTS 3,792,558 2/1974 Berce et al. ..... 52/79.12
3,942,420 3/1976 Marino ..... 118/326
4,301,764 11/1981 Campion et al. ..... 118/634
4,760,951 11/1988 MacGregor ..... 118/326
4,770,088 9/1988 Kistner .

FOREIGN PATENT DOCUMENTS 2459082 1/1981 France .
8700771 2/1987 PCT Int'l Appl. .
2141642 1/1985 United Kingdom .

*Primary Examiner*—W. Gary Jones
*Assistant Examiner*—Charles K. Friedman
*Attorney, Agent, or Firm*—Spensley Horn Jubas & Lubitz

[57] ABSTRACT

Objects to be coated enter an enclosure and a coating product with specific characteristics is sprayed onto the objects while in the enclosure. There is a respective enclosure for each of a plurality of coating products adapted to be removably attached to an external framework. Changing the coating product entails changing the enclosure.

21 Claims, 1 Drawing Sheet

INSTALLATION FOR APPLYING A COATING PRODUCT

BACKGROUND OF THE INVENTION

1. Field of the Invention

The invention concerns a method of applying a coating product, especially a powder paint fused by heat; it is more particularly concerned with an improvement which makes it possible to reduce the time needed to change the coating product, usually to change the color of the coating product, which is applied by electrostatic means.

The invention is also concerned with an installation for implementing this method.

2. Description of the Prior Art

It is known that the main problem in applying powder paint fused by heat arises from the relatively lengthy operation needed to change the color. The powder is conventionally applied by electrostatic means within a booth the pressure inside which is slightly reduced by suction. The suction means are advantageously associated with powder recovery means in the form of a centrifugal separator, for example, usually known as a "cyclone" and the clean air outlet from which is coupled to a final filter separating out powder particles recovered by the separator, before the air is returned to the atmosphere. Until now each color change has entailed cleaning the booth and the suction means. The most serious problems and greatest loss of time arise mainly from cleaning the booth. The powder recovered in the separator is generally recycled. It is therefore necessary to clean very carefully all the surfaces on which powder may be deposited whenever the nature and/or the color of the powder is changed, so that the parts are never sprayed with a mixture of different color powders. The sprayers, storage tanks and feed pipes can easily be cleaned or changed. Cleaning the filter system and in particular the separator generally does not raise any problems and can be done quickly. On the other hand, when it comes to the spray booth there has yet to be found a totally satisfactory solution to the problem of removing all traces of powder from the walls of the booth. One known solution is described in PCT application No 87-00771. According to this document the booth essentially consists of four plastics material film walls defining a sort of tunnel supported by rollers and an internal framework. Each time the color is changed the plastics material films are paid out between the rollers and the framework to provide a clean internal surface. However, the internal framework has to be cleaned by hand before the plastics material films are paid out and while the films are moving the framework may become soiled again by the powder deposited on the walls, which can constitute a source of pollution of the clean walls. This solution is therefore not fully satisfactory and moreover it uses complex mechanical devices. Also, the operation is costly because of the non-negligible consumption of plastics material film and it is difficult to implement.

The invention proposes a more economical solution that is very quick to use.

The invention arises from the observation that it is virtually impossible to prevent by any simple means the deposition of some of the sprayed powder onto the inside walls of the enclosure and that any cleaning of the walls requires lengthy intervention (which therefore renders the installation unusable for a long time) and its results are somewhat uncertain. The basic idea of the invention is therefore purely and simply to remove the enclosure each time the coating product is changed and to replace it with another corresponding to the new coating product. There is therefore provided a plurality of interchangeable enclosures the number of which corresponds to the number of different coating products to be applied. Multiple sets of such enclosures can also be provided, suited to different objects.

SUMMARY OF THE INVENTION

In one aspect the present invention consists in a method of applying a coating product to objects to be coated whereby said objects to be coated enter an enclosure and a coating product with specific characteristics is sprayed onto said objects while in said enclosure, there being a respective enclosure for each of a plurality of products adapted to be removably attached to an external framework, changing the coating product entailing changing the enclosure.

The enclosures are preferably made from a flexible material so that they can be folded up and stored in minimum space. The enclosure is deployed and takes its shape when attached to said framework, by external attachment means such as flexible, optionally elasticated, ties.

In another aspect, the invention consists in an installation for applying a coating product comprising a fixed framework and a plurality of enclosures having a shape and size such that they are adapted to be placed in said framework and attached to it to be supported by it.

The invention will be better understood and other advantages of the invention will emerge more clearly from the following description of various embodiments given by way of example only and with reference to the appended diagrammatic drawings.

DETAILED DESCRIPTION OF THE INVENTION

Figure 1:
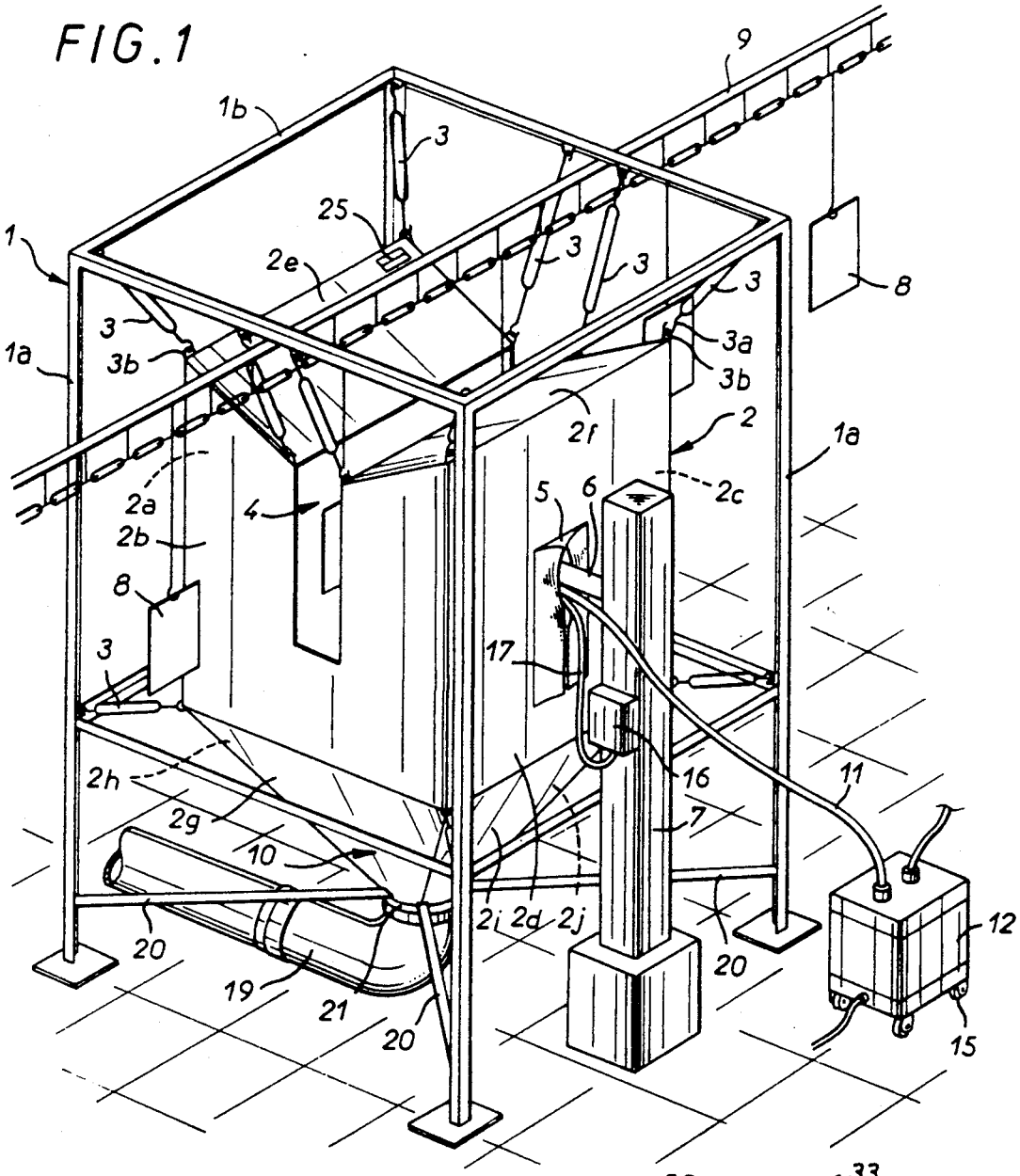
FIG. 1 is a schematic perspective view of an installation in accordance with the invention for applying a coating product.

With particular reference to FIG. 1, the installation shown comprises a rigid supporting framework 1 and a flexible material enclosure 2 made from a plastics material such as polyethylene deployed inside said framework and supported by it. The installation actually comprises a plurality of enclosures 2, the other enclosures each corresponding to a specific coating product and being folded up and stored pending use in place of the enclosure attached to said fixed framework 1. The framework is approximately rectangular parallelepiped-shape and comprises an assembly of vertical uprights 1*a* and horizontal crossmembers 1*b*. These members are advantageously made from an insulative material or covered with a thick layer of insulative material. When deployed each enclosure has a shape similar to that of the framework but with smaller dimensions and the enclosure in use is attached to the framework by flexible ties 3, here in the form of elastic tensioners. These tensioners are fitted with hooks 3*a* which cooperate with attachment rings 3*b* provided at or attached to chosen points on the enclosure, in particular at its ends. The enclosure 2 is made up of flexible plastics material panels assembled together edge-to-edge, by welding, for example. In the FIG. 1 example the enclosure comprises four substantially vertical walls 2*a*, 2*b*, 2*c*, 2*d*, two slightly inclined top walls 2*e*, 2*f* and four inclined bottom walls 2*g*, 2*h*, 2*i*, 2*j* forming a hopper 10 terminating in a circular orifice. The enclosure is further provided with a wide opening 4 extending across all of its upper part between the sides 2*e* and 2*f* and continuing in the form of vertical slots down the opposite vertical sides 2*b* and 2*c*. The opening 4 enables objects 8 to be coated suspended from an overhead conveyor 9 to pass in translation through the enclosure. The conveyor is arranged to convey the objects from one end of the enclosure to the other through the opening 4. It is grounded. At least one other opening 5 is provided, in this instance in the side 2*d* of the enclosure, to enable an electrostatic sprayer device 6 to enter the enclosure. The sprayer 6 is carried by a reciprocating mechanism 7 situated outside the enclosure and which moves it vertically so that the powder jet is swept across the entire height of the objects 8 to be coated. This opening 5 may be a simple slit cut when required. The cut parts may advantageously form lips which partially close off the opening 5. The sprayer device 6 is supplied with fluidized powder by a pipe 11 which is connected to a powder storage tank 12 inside which the powder is kept fluidized. This storage tank is of conventional design and does not form any part of the invention. It is mounted on wheels 15 so that it can easily be moved and changed when the user decides to change the coating product. An electrical generator 16 mounted on the mechanism 7 supplies electrical energy to the sprayer device 6 by way of an electrical cable 17. The bottom orifice of the hopper 10 is connected by a quick-release clamping collar 21 to the end of a conduit 19 coupled to conventional suction means (not shown). The suction means incorporate a centrifugal separator or "cyclone". The end of the conduit 19 is fixed to the lower part of the framework by guy ropes 20 or the like extending between the uprights of said framework and the end of the conduit. These guy ropes 20 advantageously constitute a horizontal support that can be used when the enclosure is folded up after use.

In the conventional way air is constantly sucked out from the enclosure, entraining with it some of the powder that is not deposited on the objects. The major part of the powder is recovered in the centrifugal separator and recycled to the storage tank 12. The air leaving the separator is returned to the atmosphere after passing through a filter which separates out the final powder particles that were not recovered in the separator. The filter is cleaned from time to time, but the powder that it separates out is not recycled. The separator can be cleaned very quickly and easily when the coating product is changed, by simply sucking clean air, and possibly by passing through it a cloth introduced into the suction system. However, when the electrostatically charged powder is sprayed onto the grounded object 8 some is deposited on the inside walls of the enclosure.

The invention does away with the need to clean the enclosure each time the coating product is changed. Instead the enclosure in use is replaced by another enclosure corresponding to the next coating product. Thus if the coating products differ only in terms of their color the installation will comprise as many folding enclosures as colors. The operations involved in changing the coating products are as follows:

Spraying of the powder is stopped and the mechanism 7 is immobilized in the lower position. The pipe 11 is disconnected from the storage tank 12 and clean air is fed into it to clean both the pipe 11 and the sprayer device 6. The enclosure 2 is shaken by hand to shake off most of the powder covering the walls which drops into the hopper and is fed to the separator. The elastic tensioners 3 are then detached, beginning at the top, enabling the enclosure to be folded on the guy ropes 20. The collar 21 is then released, which frees the enclosure entirely. Then the separator is cleaned; these operations are conventional.

The installation is then ready to receive another enclosure 2 corresponding to the new coating product contained in another powder storage tank 12. The new enclosure is fitted by a succession of operations which are the converse of those described above.

Experience has shown that an operator can carry out all the operations described above in approximately one tenth the time needed to clean a single fixed enclosure, whilst eliminating in a much more secure way any risk of pollution of a recovered coating product by another. The flexible plastics material enclosures are not costly.

The material from which the enclosure is made is preferably an insulative material, to limit the quantity of powder deposited on the walls. Thus should the powder be ignited by a spark, for example, the amount of powder that can burn will be relatively small and will release little heat. Note also that the use of thin flexible films increases safety if the powder catches fire because deformation of the walls prevents the pressure rising inside the enclosure. This eliminates any risk of the enclosure exploding.

Nevertheless, to avoid discharges due to the deposition of charged particles on the walls consideration may be given to making at least parts of the inside surfaces of the enclosure conductive, for example by low-density metalization, and grounding them.

The material from which the enclosure is made is advantageously translucent or transparent. This allows a flame detector photo-electric cell 25 or like means to be placed outside the enclosure, preferably facing a wall of the enclosure that is relatively better sheltered from the coating product. The cell may be installed facing the wall 2*e* or 2*f*, for example. In the past this cell was conventionally located inside the enclosure and therefore often covered with powder, compromising its function.

Consideration may also be given to using enclosures of different shapes corresponding to different objects to be coated, provided that the enclosures can be mounted inside the same framework, having the necessary anchor points and attachment means.

Figure 2:
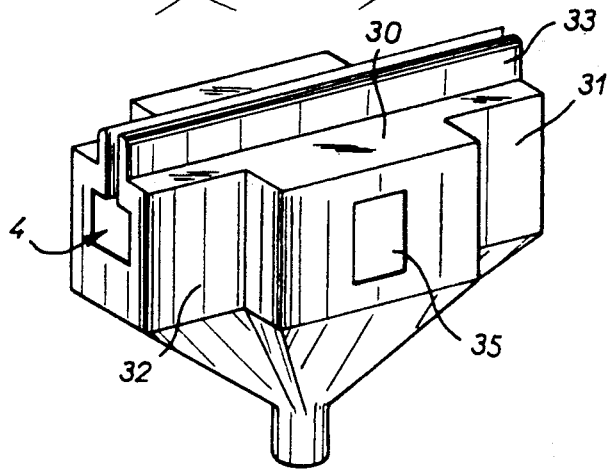
FIG. 2 is a schematic perspective view of another embodiment of enclosure usable in an installation of this kind.

FIG. 2 shows an alternate enclosure provided with extensions at the sides and/or at the top to form "airlocks", so to speak. This makes it possible to reduce turbulence in the spraying area and leakage of particles of powder into the surrounding area. The external framework is not shown in FIG. 2 but it is clear that the shape of the framework is adapted to the new shape of enclosure. The latter comprises a spray chamber 30 and two lateral chambers forming inlet and outlet "airlocks" 31, 32 which therefore extend the lateral ends of the opening 4 shown in the FIG. 1 embodiment. The upper part of this opening, through which the object supports pass, is also extended upwardly by a longitudinal "airlock" 33. The lower parts of the "airlocks" 31 and 32 are joined to the hopper. In the example shown the sprayer chamber 30 comprises an opening 35 enabling access by the operator who in this instance uses a hand sprayer.

I claim:

1. Installation for applying a coating product comprising a fixed framework and a plurality of enclosures each adapted to be individually placed in said framework, each said enclosure being composed of top, bottom and side walls enclosing a product coating region; attachment means detachably securing a selected one of said enclosures to, and within, said framework, wherein each enclosure is made from a flexible material and can therefore be folded; and coating product delivery apparatus including spraying means for spraying the coating product onto objects in said enclosure, wherein at least some parts of the inside surfaces of said enclosures are electrically conductive and adapted to be grounded.

2. Installation according to claim 1 wherein said electrically conductive parts are metalized.

3. Installation for applying a coating product comprising a fixed framework and a plurality of enclosures each adapted to be individually placed in said framework, each said enclosure being composed of top, bottom and side walls enclosing a product coating region and having first and second openings in two opposite sidewalls to enable objects to be coated to pass through said enclosure and a third opening via which the coating product is conducted into the enclosure to be sprayed onto the objects; attachment means detachably securing a selected one of said enclosures to, and within, said framework; and coating product delivery apparatus including spraying means for spraying the coating product onto objects in said selected enclosure, said apparatus being disposed for delivering the coating product into said selected enclosure via said third opening.

4. Installation according to claim 3 wherein each said enclosure comprises a plurality of panels which define said walls and are permanently secured together.

5. Installation according to claim 3 wherein said framework is substantially rectangular parallelepiped-shape and comprises rigid uprights and crossmembers and each enclosure is a similar shape to said framework but smaller than said framework, and said attachment means comprise flexible ties extending between said framework and said selected enclosure.

6. Installation according to claim 5 wherein said ties are elastic components.

7. Installation according to claim 3 wherein each enclosure is made form a flexible material and can therefore be folded.

8. Installation according to claim 7 wherein each enclosure comprises flexible material panels assembled together edge-to-edge and said enclosure is deployed in use by its attachment to said framework, said attachment means being provided at chosen locations on the outside of each enclosure.

9. Installation according to claim 8 wherein said panels are plastics material films.

10. Installation for applying a coating product comprising a fixed framework and a plurality of enclosures each adapted to be individually placed in said framework, each said enclosure being composed of top, bottom and side walls enclosing a product coating region; attachment means detachably securing a selected one of said enclosures to, and within, said framework; and coating product delivery means including spraying means for spraying the coating product onto objects in said enclosure, wherein each enclosure is made from a flexible material and can therefore be folded, wherein each enclosure comprises flexible material panels assembled together edge-to-edge and said enclosure is deployed in use by its attachment to said framework, said attachment means being provided at chosen locations on the outside of each enclosure, and wherein each enclosure comprises a wide opening across the whole of its top and in two opposite vertical sides to enable objects to be coated to pass through it.

11. Installation according to claim 10 wherein each enclosure comprises at least one other opening to enable said apparatus for spraying a coating product to enter it.

12. Installation according to claim 11 wherein said at least one other opening is a slit.

13. Installation according to claim 10, wherein one of said enclosures further comprises at least one extension member disposed to define an airlock, said extension member being formed to extend said opening in a given direction.

14. Installation for applying a coating product comprising a fixed framework and a plurality of enclosures each adapted to be individually placed in said framework, each said enclosure being composed of top, bottom and side walls enclosing a product coating region; attachment means detachably securing a selected one of said enclosure to, and within, said framework, wherein each enclosure is made from a flexible material and can therefore be folded, wherein each enclosure comprises flexible material panels assembled together edge-to-edge and said enclosure is deployed in use by its attachment to said framework, said attachment means being provided at chosen locations on the outside of each enclosure; and coating product delivery apparatus including spraying means for spraying the coating product onto objects in said enclosure, wherein said bottom of each enclosure is shaped like a hopper and provided with an orifice and further comprising a conduit in a lower part of said framework adapted to be connected to said orifice and suction means connected to said conduit.

15. Installation according to claim 14 further comprising means for fixing the end of said conduit to a lower part of said framework.

16. Installation according to claim 15 wherein said means for fixing the end of said conduit constitute a support for folding one of said enclosures after use.

17. Installation according to claim 14 wherein said suction means include a centrifugal separator.

18. Installation for applying a coating product comprising a fixed framework and a plurality of enclosures each adapted to be individually placed in said framework each said enclosure being composed of top, bottom and side walls enclosing a product coating region; attachment means detachably securing a selected one of said enclosures to, and within, said framework; and coating product delivery apparatus including spraying means for spraying the coating product onto objects in said enclosure, wherein said flexible material is electrically insulative.

19. Installation for applying a coating product comprising a fixed framework and a plurality of enclosures each adapted to be individually placed in said framework, each said enclosure being composed of top, bottom and side walls enclosing a product coating region; attachment means detachably securing a selected one of said enclosures to, and within, said framework, wherein each enclosure is made from a flexible material and can therefore be folded; and coating product delivery apparatus including spraying means for spraying the coating product onto objects in said enclosure, wherein said flexible material is transparent or translucent and further comprising flame detector means outside said selected enclosure.

20. Installation according to claim 19 wherein one wall of said selected enclosure is more sheltered from coating product during application of a coating product than is another wall of said selected enclosure, and said flame detector means face said one wall of said selected enclosure.

21. Installation according to claim 19 wherein said flame detector means comprise a photo-electric cell.

* * * * *